US012168918B2

(12) United States Patent
Ciufu et al.

(10) Patent No.: US 12,168,918 B2
(45) Date of Patent: Dec. 17, 2024

(54) ANNULUS PRESSURE REGULATION SYSTEMS AND METHODS

(71) Applicant: SAUDI ARABIAN OIL COMPANY, Dhahran (SA)

(72) Inventors: Alexandru Cosmin Ciufu, Khurais (SA); Sajid Mehmood, Khurais (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/194,285

(22) Filed: Mar. 31, 2023

(65) Prior Publication Data

US 2024/0328290 A1 Oct. 3, 2024

(51) Int. Cl.

| | |
|---|---|
| ***E21B 43/12*** | (2006.01) |
| ***E21B 34/02*** | (2006.01) |
| ***E21B 47/06*** | (2012.01) |

(52) U.S. Cl.
CPC ..... *E21B 43/128* (2013.01); *E21B 34/02* (2013.01); *E21B 47/06* (2013.01)

(58) Field of Classification Search
CPC ..... E21B 47/06; E21B 44/06; E21B 2200/02; E21B 34/02; E21B 43/128
See application file for complete search history.

(56) References Cited

U.S. PATENT DOCUMENTS

| | | | | |
|---|---|---|---|---|
| 6,089,322 | A | 7/2000 | Kelley et al. | |
| 11,047,199 | B2 | 6/2021 | Sredensek | |
| 11,261,712 | B2 | 3/2022 | Muraikhi | |
| 2002/0074127 | A1* | 6/2002 | Birckhead | E21B 47/047 166/372 |
| 2002/0121376 | A1* | 9/2002 | Rivas | E21B 43/128 166/372 |
| 2015/0136435 | A1* | 5/2015 | Hassel | H01B 7/292 174/47 |
| 2015/0233228 | A1* | 8/2015 | Roth | E21B 43/122 166/372 |
| 2016/0298631 | A1* | 10/2016 | Reid | F04D 13/10 |
| 2020/0116154 | A1* | 4/2020 | Lu | E21B 17/046 |
| 2021/0115782 | A1* | 4/2021 | Mujica | F04B 49/08 |

FOREIGN PATENT DOCUMENTS

| | | |
|---|---|---|
| CN | 112211590 A | 1/2021 |

* cited by examiner

*Primary Examiner* — Brad Harcourt
(74) *Attorney, Agent, or Firm* — Vorys, Sater, Seymour and Pease LLP

(57) ABSTRACT

A method includes operating a downhole electrical submersible (ESP) assembly arranged at a distal end of production tubing arranged within a wellbore, monitoring a real-time annulus pressure within an annulus defined between the production tubing and an inner wall of the wellbore, the ESP assembly including a power cable extending within the annulus, providing the real-time annulus pressure reading to a control system arranged at a well surface and in communication with a pressure regulator valve, comparing the real-time annulus pressure reading with a predetermined target pressure for the annulus, sending a command signal to the pressure regulator valve when the real-time annulus pressure exceeds the predetermined target pressure, and operating the pressure regulator valve in one or more steps and at predefined time intervals to thereby selectively bleed an annulus fluid from the annulus, which prevents rapid decompression of the annulus and thereby protects the power cable.

20 Claims, 3 Drawing Sheets

ANNULUS PRESSURE REGULATION SYSTEMS AND METHODS

FIELD OF THE DISCLOSURE

The present disclosure relates generally to hydrocarbon producing wells and, more particularly, to the management of annulus pressure in wells that include an electric submersible pump.

BACKGROUND OF THE DISCLOSURE

Hydrocarbon producing wells include configurations of permanent and semi-permanent equipment that may be installed during well construction to maintain or increase production over the life of the well. An electric submersible pump (ESP) and associated components are one such type of semi-permanent (or permanent) equipment that is often utilized to assist in artificially lifting hydrocarbons to the well surface for production.

Over time, and as the well is produced, the wellbore is exposed to conditions that may be detrimental to the equipment installed therein. The wellbore, including the various annuli within the wellbore, will likely experience pressure fluctuations that may be especially damaging to more vulnerable downhole equipment. Accordingly, it is advantageous to employ mechanisms and methodologies to alleviate, as much as is possible, such detrimental effects.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method may include operating a downhole electrical submersible (ESP) assembly that may be arranged at a distal end of production tubing arranged within a wellbore extending from a wellhead arranged at a well surface and monitoring a real-time annulus pressure within an annulus defined between the production tubing and an inner wall of the wellbore, wherein the ESP assembly includes a power cable extending within the annulus between the ESP assembly and the well surface. The method may further include providing the real-time annulus pressure to a control system that may be arranged at the well surface and in communication with a pressure regulator valve arranged within a surface pipe extending from the wellhead and in fluid communication with the annulus. The method may further include comparing within the control system the real-time annulus pressure with a predetermined target pressure for the annulus, sending a command signal from the control system to the pressure regulator valve when the real-time annulus pressure exceeds the predetermined target pressure, and based on the command signal, operating the pressure regulator valve in one or more steps and at predefined time intervals to thereby selectively bleed an annulus fluid from the annulus. The bleed of the annulus fluid which may prevent rapid decompression of the annulus fluid within the annulus and thereby protects the power cable within the annulus from damage.

According to an embodiment consistent with the present disclosure, a well system may include production tubing arranged within a wellbore extending from a wellhead arranged at a well surface and a downhole electrical submersible (ESP) assembly arranged at a distal end of the production tubing and including a power cable extending between the ESP assembly and the well surface within an annulus defined between the production tubing and an inner wall of the wellbore. The well system may further include a pressure regulator valve arranged within a surface pipe extending from the wellhead and in fluid communication with the annulus and a control system communicably coupled to the pressure regulator valve and programmed to operate the pressure regulator valve to selectively bleed an annulus fluid from the annulus in one or more steps and at predefined time intervals, which may protect the power cable within the annulus by preventing rapid decompression of the annulus fluid within the annulus.

According to an embodiment consistent with the present disclosure, a non-transitory, computer readable medium programmed with computer executable instructions that, when executed by a processor of a computer unit, may cause the processor to monitor a real-time annulus pressure within an annulus defined between production tubing extended into a wellbore and an inner wall of the wellbore, wherein a downhole electrical submersible (ESP) assembly is arranged at a distal end of production tubing and a power cable extends within the annulus between the ESP assembly and the well surface. The non-transitory, computer readable medium may further cause the processor to provide the real-time annulus pressure to a control system arranged at the well surface and in communication with a pressure regulator valve arranged within a surface pipe extending from a wellhead and in fluid communication with the annulus and compare the real-time annulus pressure with a predetermined target pressure for the annulus. Additionally, a non-transitory, computer readable medium may cause the processor to send a command signal from the control system to the pressure regulator valve when the real-time annulus pressure exceeds the predetermined target pressure and based on the command signal, operate the pressure regulator valve in one or more steps and at predefined time intervals to thereby selectively bleed an annulus fluid from the annulus, which prevents rapid decompression of the annulus fluid within the annulus and thereby protects the power cable within the annulus from damage.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
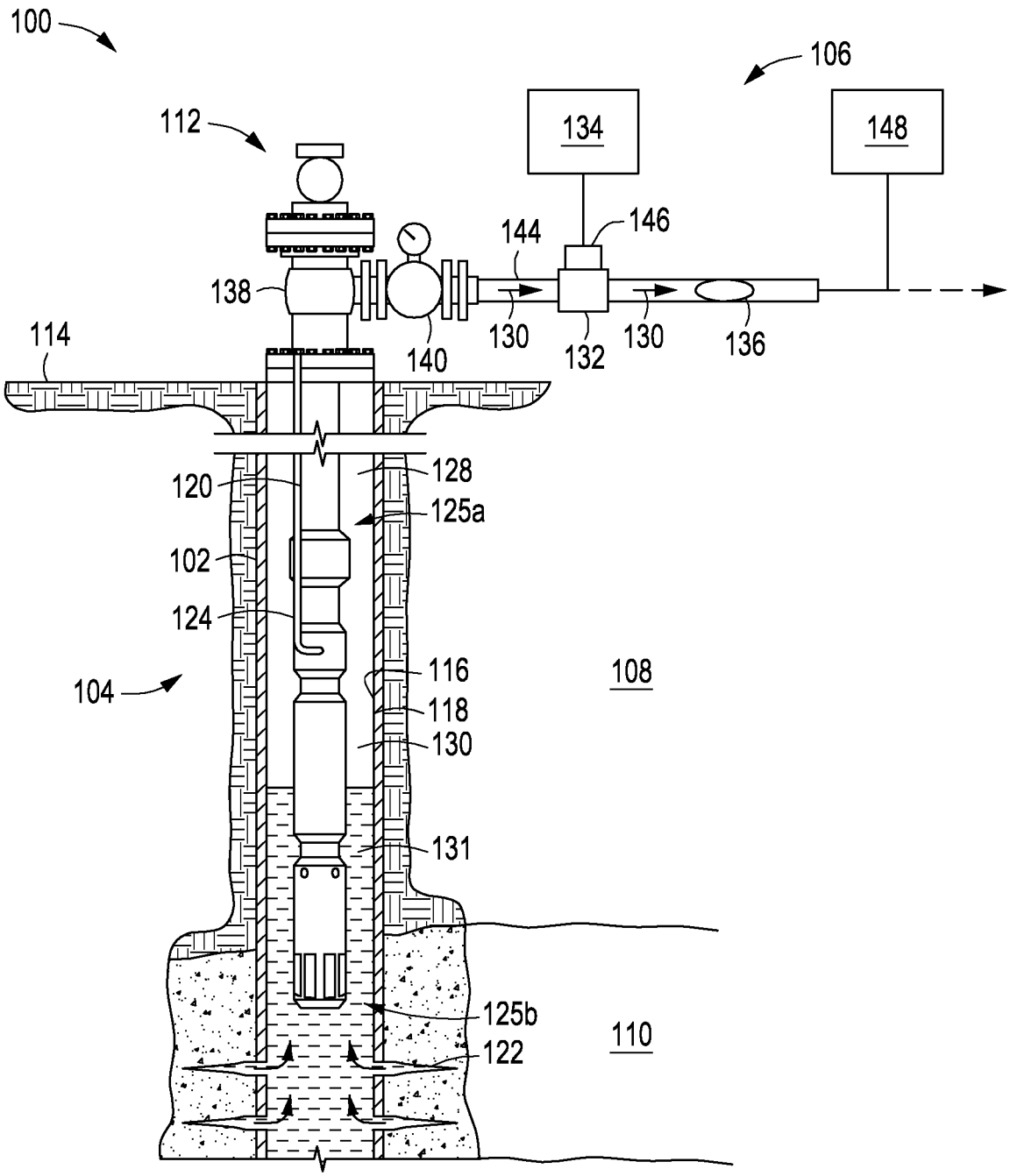
FIG. 1 is a schematic diagram of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to hydrocarbon producing wells and, more particularly, to the management of annulus pressure in hydrocarbon producing wells that include an electric submersible pump (ESP). As a wellbore is produced, the wellbore experiences changing downhole conditions that may affect the internal pressures to which tools deployed within a wellbore, like an ESP, are exposed. Examples of such varying downhole conditions include, but are not limited to, changes to reservoir conditions, flow rates (e.g., changes in producing flow rate) and temperature. Depending upon the construction and configuration of the wellbore, some downhole tools may be exposed to pressure fluctuations that may lessen (or in some cases, end) their working life.

In wellbores that employ artificial lift equipment, such as an ESP system, pressure fluctuations can be particularly detrimental to the power cables that extend within the tubing-to-casing annulus to convey the needed electrical power to operate the downhole ESP system. Effectively managing the pressure within the annulus can extend the working life of the ESP power cable, and thus the entirety of the ESP system. The systems and methods disclosed herein describe a surface positioned pressure regulator and interconnected control system that may be autonomously adjusted without requiring manual manipulation to optimize the annulus pressure, and thus avoid potential destruction of downhole equipment.

FIG. 1 is a schematic diagram of an example well system 100 that may incorporate the principles of the present disclosure. In the illustrated embodiment, the well system 100 includes a wellbore 102, a wellhead 112, a downhole electrical submersible (ESP) assembly 104, and surface components externally located to the wellbore 102, collectively referred to herein as the ESP surface equipment 106.

As illustrated, the wellbore 102 may penetrate a submerged oil and gas formation 108 comprising a producible reservoir 110. The wellbore 102 extends from the wellhead 112 positioned upon a terrestrial surface 114 (i.e., the Earth's surface), alternately referred to herein as the "well surface 114". The wellhead 112 generally provides structural support and pressure containment for the wellbore 102 and may include any configuration of spools and housings in accordance with construction of the wellbore 102.

Although FIG. 1 depicts the well system 100 as a land-based application, it will be appreciated that the various embodiments discussed herein are equally well suited for use in conjunction with other types of well systems, such as offshore oil and gas rigs and/or platforms or rigs located at any other geographical site. Moreover, while the wellbore 102 is shown in FIG. 1 as extending generally vertical, in other embodiments, the wellbore 102 may comprise some generally horizontal portion (substantial or otherwise) without departing from the spirit and scope of this disclosure.

The wellbore 102 may be lined with one or more strings of casing 116 cemented within the wellbore 102 using cement 118. In at least one embodiment, a string of tubing 120, such as production tubing, may extend from the wellhead 112 (or another location) and be arranged within the casing 116. Both the tubing 120 and the casing 116 may extend at least partially into the distal end of the wellbore 102. In other embodiments, a liner (not shown) may be installed within the wellbore 102, wherein the tubing 120 extending from the wellhead 112 may be secured within the liner top. In some embodiments, the casing 116 may be omitted from downhole portions of the wellbore 102, and the tubing 120 may be extended to an open-hole section of the wellbore 102. Accordingly, the wellbore 102 may be constructed as operationally necessary, without departing from the spirit and scope of this disclosure.

In the present embodiment, a plurality of perforations 122 are defined in the wellbore 102 and extend radially outward through the casing 116 and the cement 118 and into the producible reservoir 110. The perforations 122 help facilitate fluid communication between the reservoir 110 and the wellbore 102 by providing conduits (flow channels) through which hydrocarbons 131 (e.g., oil and gas) can migrate into the wellbore 102 for production.

Producing wellbores are often constructed so as to include downhole equipment that may be utilized to either increase initial hydrocarbon production rate or similarly, to facilitate future hydrocarbon production when the reservoir begins to deplete. Electrical submersible pump (ESP) systems are commonly utilized for this purpose, wherein a downhole motor powered by surface sourced electricity powers a downhole pump (i.e., the ESP) which ultimately acts to pressurize and artificially "lift" hydrocarbons to the well surface that would otherwise not have the pressure and natural flow capabilities to do so.

In FIG. 1, the downhole electrical submersible (ESP) assembly 104 is emplaced within the tubing 120 at its distal end and is operable to artificially lift the hydrocarbons 131 entering the wellbore 102 via the perforations 122 to the surface 114 for production. The ESP assembly 104 may comprise a configuration of downhole components that may include a motor, a seal chamber, a pump intake, a pump, and one or more sensors. The sensor(s) are configured and operable to record downhole real-time measurements that may be transmitted to the well surface 114. The ESP assembly 104 further includes a power cable 124 extended from the well surface 114 to power various electrical components of the ESP 104, such as the motor and the sensors. In some embodiments, the ESP assembly 104 may include multiple pumps, axially aligned and operatively coupled in a multistage pump configuration. Accordingly, the ESP assembly 104 may be configured to meet the production needs and requirements of the wellbore 102.

The ESP assembly 104 has an upper end 125*a* and a lower end 125*b* opposite the upper end 125*a*, and may be advanced into the wellbore 102 until the lower end 125*b* is positioned at a predetermined distance above (uphole from) the perforations 122. The upper end 125*a* of the ESP assembly 104 may be operatively coupled to the tubing 120.

With the tubing 120 extended into the wellbore 102, an annulus 128 is defined between the tubing 120 and the casing 116. Prior to production, the annulus 128 may be filled with an annulus fluid 130, such as a completion fluid like a brine. In other embodiments, the annulus fluid 130 may be any fluid with the appropriate characteristics (e.g., density, flow capabilities, chemical compatibility with the reservoir 110, low solids content, etc.) to meet the needs and requirements of the downhole components of the wellbore 102 Once production commences, the annulus 128 may contain hydrocarbons 131 that have migrated into the wellbore 102 via the perforations 122, and the ESP assembly 104 is operable to draw the hydrocarbons 131 into the tubing 120 for production to the well surface 114. In some embodiments, the annulus 128 may include a production packer (not shown) or similarly a plurality of packers, positioned a predetermined distance above (uphole from) the perforations 122. In such an embodiment, the annular space above the packer may be filled with a packer fluid such as a diesel or corrosion-inhibiting brine. Accordingly, the annular space below the packer may comprise formation fluids that include hydrocarbons 131 (e.g., oil and/or gas). Often the packer will be operable to prevent any passage of annulus fluid 130 or hydrocarbons 131 between the respective annular spaces above and below the packer. However, some packer designs may permit the migration of gas from below the packer to the annular space above the packer.

The power cable 124 may be extended from the well surface 114 to the ESP assembly 104 within the annulus 128. Consequently, the power cable 124 may be directly exposed to the annulus fluid 130 present within the annulus 128. In some embodiments, the power cable 124 may be coupled to the exterior of the tubing 120 at discretionary intervals via clamps or other known mechanical means. In such embodiments, the tubing 120 may provide structural support to the power cable 124, which typically exhibits elastic characteristics. The power cable 124 may be designed to withstand high temperatures, high pressures, corrosive fluids, and the like. Accordingly, the power cable 124 may include insulation and a protective "jacket" arranged around the exterior of the power cable 124 in order to prevent potential failure.

As illustrated in FIG. 1, the wellhead 112 includes a tubing head housing (THH) 138, which may be fluidly and operatively coupled to the tubing 120 extended within the wellbore 102. The THH 138 may also be fluidly and operatively coupled to the annulus 128, and a tubing annulus access valve 140 may be secured to the THH 138 to provide a pathway for fluid communication, pressure monitoring, and/or general access to the annulus 128 from the well surface 114. A surface conduit or pipe 144 (pipeline) may extend from the tubing annulus access valve 140 and may be configured to receive the flow of the annulus fluid 130 from the annulus 128.

A pressure regulator valve 132 is arranged within the surface pipe 144 and positioned downstream from the tubing annulus access valve 140. The pressure regulator valve 132 may comprise a control valve operable to control the volume of the annulus fluid 130 exiting the annulus 128, and thus control the pressure within the annulus 128. The pressure regulator valve 132 may comprise any type of valve, such as a gate valve, and may be adjustable between fully open or closed positions to maintain and/or optimize the pressure within the annulus 128. In contrast to a pressure relief valve, which opens upon reaching a predetermined threshold pressure, the pressure regulator valve 132 may be operable to receive and control flow continuously, and adjusting the operational position of the pressure regulator valve 132 may be performed in real-time to allow for continuous annular flow and pressure management.

The well system 100 may further include a control system 134 in communication with the pressure regulator valve 132. In some embodiments, the control system 134 may comprise a separate component part that remotely communicates with the pressure regulator valve 132, such as via any wired or wireless means of telecommunication. In other embodiments, however, the control system 134 may form an integral part of the pressure regulator valve 132. In any event, the control system 134 may be programmed or otherwise configured to autonomously or automatically cause the pressure regulator valve 132 to operate and thereby regulate the fluid pressure within the annulus 128. This may prove advantageous in applications where it may be necessary to bleed off pressure within the annulus 128 to prevent damage to the power cable 124.

During hydrocarbon production from the wellbore 102, the annulus 128 may be subject to extreme pressure fluctuations for a variety of reasons including, but not limited to, changing reservoir conditions, surface downstream flowing conditions (e.g., the rate of produced formation fluids), downhole temperature, etc. As a result, the annulus fluid(s) 130 within the annulus 128 may be subject to pressure changes. Pressure variations within the annulus 128 may be further exacerbated by the utilization of packers within the annulus 128 (as mentioned above), which create smaller areas (scaled annulus compartments) in which the annulus fluid 130 may be contained and thus exposed to more concentrated pressure differentials. The ESP power cable 124 arranged within the annulus 128 experiences exposure to the same, often extreme, pressure differentials. Despite precautionary design and protection measures, the power cable 124 may still be particularly susceptible to failure when exposed to extreme or high pressure differentials within the annulus 128.

To help mitigate or prevent the failure of the power cable 124 (and similarly, failure to the casing 116 and tubing 120) the fluid pressure within the annulus 128 can be selectively, sequentially, and strategically bled-off via the pressure regulator valve 132. However, should the pressure relief operation be uncontrolled or relieved too quickly, the power cable 124 may experience rapid decompression. In some cases, the power cable 124 may endure explosive decompression, wherein the protective outer barrier (e.g., insulation, jacket, armor) of the power cable 124 may be destroyed and leaves the fragile interior conductors exposed and/or immediately damaged. Such a result may ultimately lead to failure of the power cable 124 and the thus inoperability of the entire ESP assembly 104.

According to embodiments of the present disclosure, the annulus 128 may be relieved of pressure strategically and systematically, without causing harm or potential failure of the power cable 124. More particularly, operation of the pressure regulator valve 132 may be automated using the control system 134 to optimize the pressure within the annulus 128, which corresponds to extending the life of the ESP power cable 124.

In some embodiments, the control system 134 may be communicably coupled to various sensors and gauges (not shown) arranged within the wellbore 102 and the wellhead 112. The control system 134 may also be in communication with various sensors and gauges forming part of the ESP assembly 104. Accordingly, the control system 134 may be provided with real-time measurements and data including, but not limited to, downhole pressure, pressure within the annulus 128, downhole temperature, temperature within the annulus 128, as well as wellhead 112 pressure and temperature. The control system 134 may be programmed and configured to recognize and record the real-time pressure within the annulus 128, and compare that measurement/reading with a predetermined target pressure for the annulus 128. Once the real-time pressure within the annulus 128 meets or exceeds the predetermined target pressure, the control system 134 may be programmed to send a command signal to the pressure regulator valve 132 to adjust the flow rate of the annulus fluid(s) 130 within the surface pipe 144 and thereby adjust the fluid pressure within the annulus 128.

In some embodiments, the well system 100 may include a motor 146 operatively coupled to or forming part of the pressure regulator valve 132 and in communication with the control system 134. In such embodiments, the control system 134 may communicate with the motor 146 to operate the pressure regulator valve 132 and thereby adjust the operational position of the pressure regulator valve 132. In doing so, the control system 134 may be operable to manipulate and adjust the operational position of the pressure regulator valve 132 via transmission of commands, facilitating autonomous adjustment of the operational position of the pressure regulator valve 132.

The control system 134 may be programmed to maintain a threshold pressure within the annulus 128, as determined and set by an operator. The control system 134 may also be programed with well specific algorithms. In such examples, the control system 134 may be programmed to optimize for the specifics of the operation (e.g., an observed increase in the production rate of the hydrocarbons) once the control system 134 recognizes the operation. (To be discussed in further detail with reference to FIG. 3.)

In some embodiments, upon determining that the real-time pressure within the annulus 128 meets or exceeds the predetermined target pressure, the control system 134 may be programmed to automatically bleed off the pressure within the annulus 128 in one or more steps and at predefined time and/or pressure intervals. In such embodiments, the control system 134 may cause the pressure regulator valve 132 to open a first time to a first preset opening percentage for a first predefined time interval, thus resulting in a first pressure drop over the first predefined time interval. The first predefined time interval may comprise, for example, 10 seconds, 30 seconds, one minute, 5 minutes, 10 minutes, an hour, or any other desired time interval, or any time interval subset therebetween. The first pressure drop may be a pressure drop desired to be achieved during the first predefined time interval, thus the control system 134 may be programmed to adjust the opening percentage of the pressure regulator valve 132 in conjunction with the predefined time interval to achieve the desired pressure drop, which could be about 25 psi, about 50 psi, about 100 psi, or any other desired pressure, or any pressure therebetween.

Following the expiration of the first predefined time interval and the associated pressure drop, the pressure regulator valve 132 may be closed. Subsequently the control system 134 may cause the pressure regulator valve 132 to open a second time to a second preset opening percentage for a second predefined time interval, which may be the same as or different from the first predefined time interval. Opening the pressure regulator valve 132 the second time for the second predefined time interval may result in a second pressure drop over the second predefined time interval. The first and second preset opening percentages may be the same or different, and the resulting first and second pressure drops may be the same or different. Following the expiration of the second predefined time interval, the pressure regulator valve 132 may be closed again. This process may repeat as many times as necessary until the pressure within the annulus 128 is returned to a safe level.

A well operator may program the control system 134 with a series of algorithms developed for operational scenarios specific to the wellbore 102 that may facilitate autonomous adjustment of the operational position of the pressure regulator valve 132. In accordance with such algorithms, the control system 134 may be provided with real-time measurements and data representative of pressure fluctuations that exceed the predetermined threshold pressure. When the pressure threshold is exceeded (corresponding to an increase in pressure with the annulus 128) or more particularly, when the control system 134 determines that the pressure within the annulus 128 may be increasing, the control system 134 may communicate/direct the pressure regulator valve 132 to adjust operational positions. In doing so, the control system 134 may facilitate time-controlled bleed off of the pressure within the annulus 128 to achieve a desired pressure drop (decline); e.g., a 100 psi pressure drop within the annulus 128 over 15 minutes.

During wellbore 102 production, the annulus access valve 140 may be fully open, and thus operable to receive the annulus fluid 130 from the annulus 128 and into the surface pipe 144. In some embodiments, the annulus access valve 140 may be in communication with the control system 134, which may be programmed to adjust the annulus access valve 140 between the open and closed positions.

The fluid 130 may then travel through the surface pipe 144 to the pressure regulator valve 132. The control system 134 may then manipulate the operational position of the pressure regulator valve 132 to allow a known volume of the annulus fluid 130 to exit the annulus 128 and thus relieve pressure build-up in the annulus 128. As opposed to a conventional relief valve, utilizing the pressure regulator valve 132 enables a stabilized and controlled release of excess pressure within the annulus 128 so that the annulus 128 and the components within (namely the power cable 124) are not exposed to damaging rapid decompression. Additionally, the control system 134 may enable continuous, real-time operational positional adjustments of the pressure regulator valve 132 in order to maintain an optimum annulus 128 pressure.

In some embodiments, the well system 100 may further include a check valve 136 arranged within the surface pipe 144 downstream from the pressure regulator valve 132. The check valve 136 may comprises a one-way valve operable to prevent the back flow of the annulus fluid 130 within the surface pipe 144 and back into the annulus 128 once flowed beyond the check valve 136.

In some embodiments, the relieved annulus fluid 130 may travel beyond the check valve 136 and into a production line operatively coupled and in fluid communication with a production facility. In other embodiments, however, the well system 100 may further include an external chamber 148 configured to receive and store relieved annulus fluid 130 discharged from the pressure regulator valve 132. The chamber 148 may be fluidly coupled to the surface pipe 144 and positioned on the well surface 114 a predetermined distance from the wellhead 112. In offshore embodiments, the chamber 148 may be located on a deck of an oil and gas platform.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the control system 134 of FIG. 2. Furthermore, portions of the embodiments may be a computer program product on a computer-usable storage medium having computer readable program code on the medium. Any non-transitory, tangible storage media possessing structure may be utilized including, but not limited to, static and dynamic storage devices, hard disks, optical storage devices, and magnetic storage devices, but excludes any medium that is not eligible for patent protection under 35 U.S.C. § 101 (such as a propagating electrical or electromagnetic signal per se). As an example and not by way of limitation, a computer-readable storage media may include a semiconductor-based circuit or device or other IC (integrated circuit) (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, where appropriate.

Certain embodiments have also been described herein with reference to block illustrations of methods, systems, and computer program products. It will be understood that blocks of the illustrations, and combinations of blocks in the illustrations, can be implemented by computer-executable instructions. These computer-executable instructions may be provided to one or more processor of a general purpose computer, special purpose computer, or other programmable data processing apparatus (or a combination of devices and circuits) to produce a machine, such that the instructions, which execute via the processor, implement the functions specified in the block or blocks.

These computer-executable instructions may also be stored in computer-readable memory that can direct a computer or other programmable data processing apparatus to function in a particular manner, such that the instructions stored in the computer-readable memory result in an article of manufacture including instructions which implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

Figure 2:
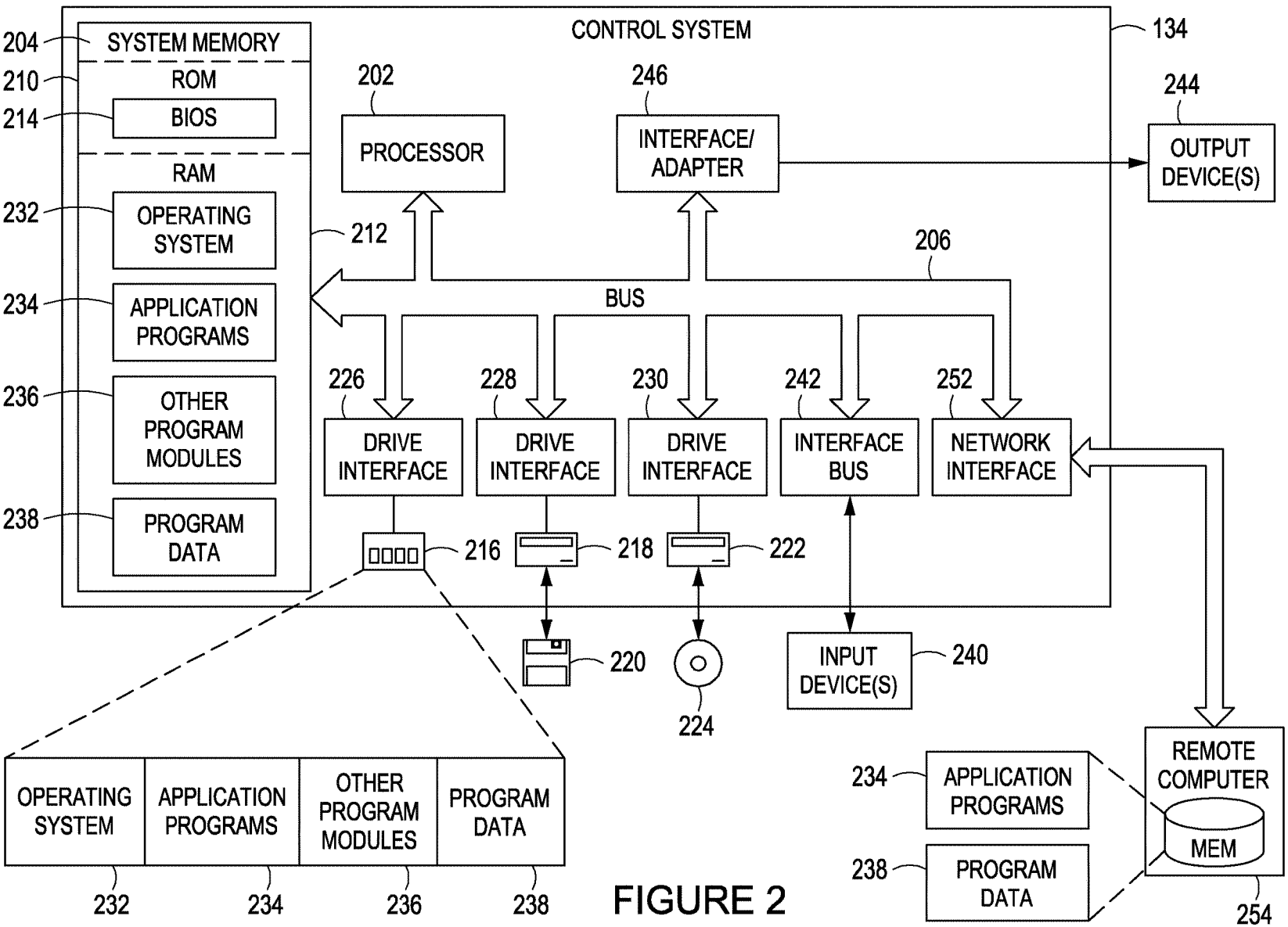
FIG. 2 is a schematic layout of the control system of FIG. 1, according to one or more embodiments.

In this regard, FIG. 2 illustrates one example of a control system 134 that can be employed to execute one or more embodiments of the present disclosure. Control system 134 can be implemented on one or more general purpose networked computer systems, embedded computer systems, routers, switches, server devices, client devices, various intermediate devices/nodes or standalone computer systems. Additionally, control system 134 can be implemented on various mobile clients such as, for example, a personal digital assistant (PDA), laptop computer, pager, and the like, provided it includes sufficient processing capabilities.

Control system 134 includes processing unit 202, system memory 204, and system bus 206 that couples various system components, including the system memory 204, to processing unit 202. Dual microprocessors and other multiprocessor architectures also can be used as processing unit 202. System bus 206 may be any of several types of bus structure including a memory bus or memory controller, a peripheral bus, and a local bus using any of a variety of bus architectures. System memory 204 includes read only memory (ROM) 210 and random access memory (RAM) 212. A basic input/output system (BIOS) 214 can reside in ROM 210 containing the basic routines that help to transfer information among elements within control system 134.

Control system 134 can include a hard disk drive 216, magnetic disk drive 218, e.g., to read from or write to removable disk 220, and an optical disk drive 222. e.g., for reading CD-ROM disk 224 or to read from or write to other optical media. Hard disk drive 216, magnetic disk drive 218, and optical disk drive 222 are connected to system bus 206 by a hard disk drive interface 226, a magnetic disk drive interface 228, and an optical drive interface 230, respectively. The drives and associated computer-readable media provide nonvolatile storage of data, data structures, and computer-executable instructions for control system 134. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 210, including operating system 232, one or more application programs 234, other program modules 236, and program data 238. In some examples, the application programs 234 can include modules that enable collection and storage of measurement sensor data, a condition recognition module wherein a threshold annulus pressure may be recognized, a proposed action module, a correction module, and similar. The program data 238 can include a generate proposed action wherein a user/operator may be notified of a suggested pressure regulator valve 132 positional change based upon the condition recognized, and/or notification of an automatic or autonomous change in the operational position of the pressure regulator valve 132 executed by the control system 134 in response to a programed algorithm and condition recognition. The application programs 234 and program data 238 can include functions and methods programmed to monitor, trouble-shoot, and/or optimize operation of the control system 134. Optimization includes adjusting the operational position of the pressure regulator valve 132 to optimize the release of annulus fluid 130, which assists in maintaining pressure variations within the annulus 128 and thus, limiting the components emplaced within to extreme pressure variations.

A user/operator may enter commands and information into control system 134 through one or more input devices 240, such as a pointing device (e.g., a mouse, touch screen), keyboard, microphone, joystick, game pad, scanner, and the like. For instance, the user can employ input device 240 to edit or modify the operational position of the pressure regulator valve 132 based upon observed annulus pressure. These and other input devices 240 are often connected to processing unit 302 through a corresponding port interface 342 that is coupled to the system bus, but may be connected by other interfaces, such as a parallel port, serial port, or universal serial bus (USB). One or more output devices 244 (e.g., display, a monitor, printer, projector, or other type of displaying device) is also connected to system bus 206 via interface 246, such as a video adapter.

Control system 134 may operate in a networked environment using logical connections to one or more remote computers, such as remote computer 248. Remote computer 248 may be a workstation, computer system, router, peer device, or other common network node, and typically includes many or all the elements described relative to control system 134. The logical connections, schematically indicated at 250, can include a local area network (LAN) and a wide area network (WAN). When used in a LAN networking environment, control system 134 can be connected to the local network through a network interface or adapter 252. When used in a WAN networking environment, control system 134 can include a modem, or can be connected to a communications server on the LAN. The modem, which may be internal or external, can be connected to system bus 206 via an appropriate port interface. In a networked environment, application programs 234 or program data 238 depicted relative to computer system 300, or portions thereof, may be stored in a remote memory storage device 254.

Figure 3:
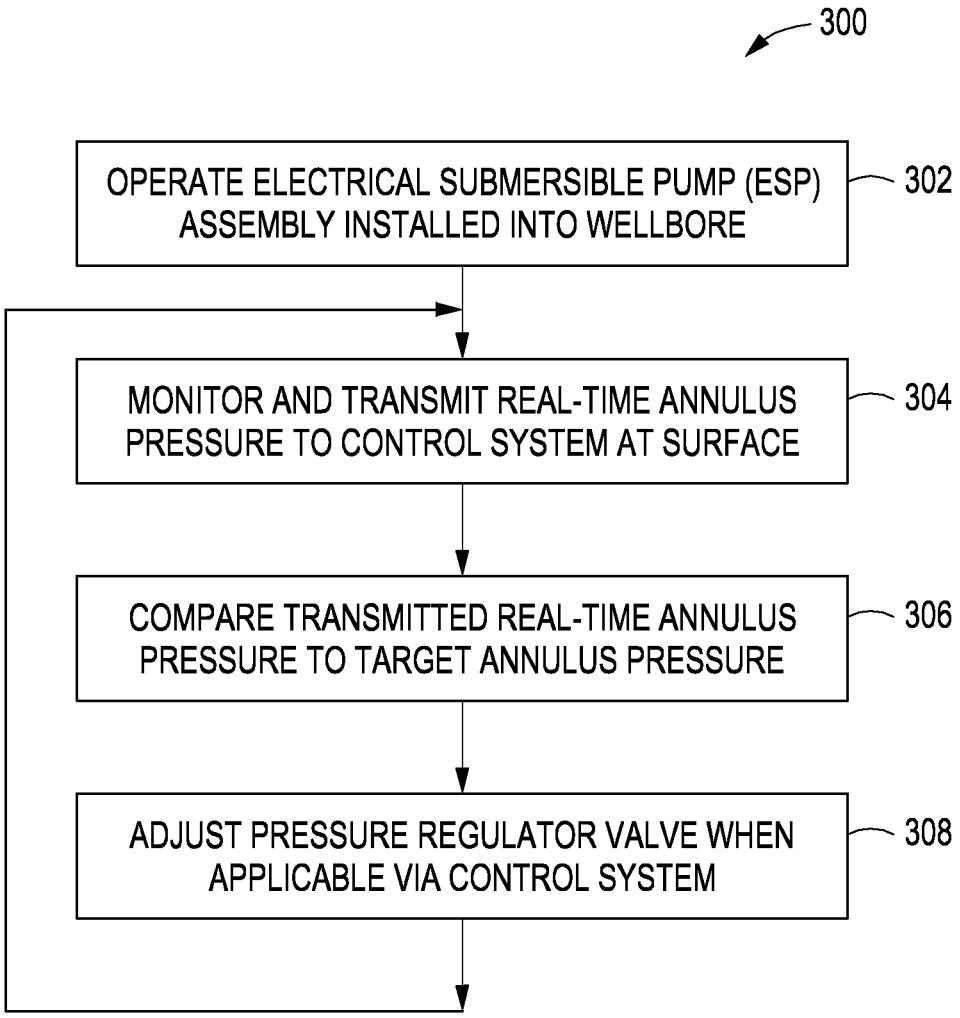
FIG. 3 is a schematic flowchart of an example annular pressure regulation method that may incorporate the principles of the present disclosure.

FIG. 3 is a schematic flowchart of an example annular pressure regulation method 300, according to one or more embodiments. The method 300 may include operating a downhole electrical submersible (ESP) assembly within a wellbore, as at 302. The wellbore may extend from a wellhead arranged at the well surface and the ESP assembly may be arranged at the distal end of production tubing extended within the wellbore. An annulus may be defined between the production tubing and the inner wall of the wellbore, the ESP assembly may include a power cable extending within the annulus from the well surface to the ESP assembly.

The method 300 may further include monitoring and then transmitting a real-time pressure reading within the annulus to a control system located at the well surface, as at 304. The control system may be in communication with a pressure regulator valve arranged within surface pipe extending from the wellhead and in fluid communication with the annulus. The method 300 may include comparing the transmitted real-time annulus pressure reading to a target annulus pressure, as at 306. In some embodiments, the control system may be programmed to compare the annulus pressures and the target annulus pressure, and the target annulus pressure may be predetermined by a user/operator.

The method 300 may further include, adjusting the pressure regulator valve when applicable with the control system, as at 308. More particularly, the control system may send a command signal to the pressure regulator valve when the real-time annulus pressure reading exceeds the predetermined target pressure. The pressure regulator valve may then, in one or more steps and at predefined time intervals, selectively bleed annulus fluid from the annulus, which may prevent rapid decompression of the annulus fluid within the annulus and thereby may protect the power cable within the annulus from damage.

Embodiments disclosed herein include:

A. A method, the method including operating a downhole electrical submersible (ESP) assembly arranged at a distal end of production tubing arranged within a wellbore extending from a wellhead arranged at a well surface and monitoring a real-time annulus pressure within an annulus defined between the production tubing and an inner wall of the wellbore, wherein the ESP assembly includes a power cable extending within the annulus between the ESP assembly and the well surface. The method further including providing the real-time annulus pressure to a control system arranged at the well surface and in communication with a pressure regulator valve arranged within a surface pipe extending from the wellhead and in fluid communication with the annulus. The method further including comparing within the control system the real-time annulus pressure with a predetermined target pressure for the annulus, sending a command signal from the control system to the pressure regulator valve when the real-time annulus pressure exceeds the predetermined target pressure, and based on the command signal, operating the pressure regulator valve in one or more steps and at predefined time intervals to thereby selectively bleed an annulus fluid from the annulus. The bleed of the annulus fluid which may prevent rapid decompression of the annulus fluid within the annulus and thereby protects the power cable within the annulus from damage.

B. A well system, the well system including production tubing arranged within a wellbore extending from a wellhead arranged at a well surface and a downhole electrical submersible (ESP) assembly arranged at a distal end of the production tubing and including a power cable extending between the ESP assembly and the well surface within an annulus defined between the production tubing and an inner wall of the wellbore. The well system further including a pressure regulator valve arranged within a surface pipe extending from the wellhead and in fluid communication with the annulus and a control system communicably coupled to the pressure regulator valve and programmed to operate the pressure regulator valve to selectively bleed an annulus fluid from the annulus in one or more steps and at predefined time intervals, which may protect the power cable within the annulus by preventing rapid decompression of the annulus fluid within the annulus.

C. A non-transitory, computer readable medium programmed with computer executable instructions that, when executed by a processor of a computer unit, cause the processor to monitor a real-time annulus pressure within an annulus defined between production tubing extended into a wellbore and an inner wall of the wellbore, wherein a downhole electrical submersible (ESP) assembly is arranged at a distal end of production tubing and a power cable extends within the annulus between the ESP assembly and the well surface. The non-transitory, computer readable medium programmed with computer executable instructions, further causing the processor to provide the real-time annulus pressure to a control system arranged at the well surface and in communication with a pressure regulator valve arranged within a surface pipe extending from a wellhead and in fluid communication with the annulus. The non-transitory, computer readable medium programmed with computer executable instructions, further causing the processor to compare the real-time annulus pressure with a predetermined target pressure for the annulus. The non-transitory, computer readable medium programmed with computer executable instructions, further causing the processor to send a command signal from the control system to the pressure regulator valve when the real-time annulus pressure exceeds the predetermined target pressure and based on the command signal, operate the pressure regulator valve in one or more steps and at predefined time intervals to thereby selectively bleed an annulus fluid from the annulus, which prevents rapid decompression of the annulus fluid within the annulus and thereby protects the power cable within the annulus from damage.

Each of embodiments A, B, and C may have one or more of the following additional elements in any combination: Element 1: further comprising operating the pressure regulator valve with the control system to maintain a threshold annulus pressure within the annulus. Element 2: further comprising selectively operating the pressure regulator valve autonomously with the control system and thereby continuously regulating a fluid pressure within the annulus. Element 3: wherein a motor is operatively coupled to the pressure regulator valve, and wherein operating the pressure regulator valve in the one or more steps and at the predefined time intervals comprises: communicating the command signal to the motor to operate the pressure regulator valve; and achieving a known pressure drop within the annulus by bleeding the annulus fluid from the annulus at the predefined time intervals. Element 4: wherein operating the pressure regulator valve in the one or more steps and the predefined time intervals comprises: opening the pressure regulator valve to a preset opening percentage at one or more of every 10 minutes, every half hour, every hour, every 5 hours, every 10 hours, every 24 hours, and any time subset therebetween, and bleeding the annulus fluid from the annulus and thereby achieving a known pressure drop of at least one of about 25 psi, about 50 psi, about 100 psi, and any pressure therebetween. Element 5: further comprising preventing backflow of the annulus fluid within the surface pipe into the annulus using a check valve arranged within the surface pipe downstream from the pressure regulator valve. Element 6: further comprising enabling continuous, real-time operational positional adjustments of the pressure regulator valve with the control system and thereby maintaining an optimum pressure within the annulus.

Element 7: wherein the control system is provided with real-time annulus pressure measurements and is programmed to: compare the real-time annulus pressure measurements with a predetermined target pressure for the annulus and send a command signal to open the pressure regulator valve when the real-time annulus pressure measurements exceed the predetermined target pressure. Element 8: wherein the control system is further programmed to maintain a threshold pressure within the annulus. Element 9: wherein the control system operates autonomously to selectively operate the pressure regulator valve and thereby regulate a fluid pressure within the annulus. Element 10: further comprising a motor operatively coupled to the pressure regulator valve, wherein the control system communicates with the motor to operate the pressure regulator valve. Element 11: wherein operating the pressure regulator valve in the one or more steps and the predefined time intervals comprises: opening the pressure regulator valve to a preset opening percentage at one or more of every 10 minutes, every half hour, every hour, every 5 hours, every 10 hours, every 24 hours, and any time subset therebetween and bleeding the annulus fluid from the annulus and thereby achieving a known pressure drop of at least one of about 25 psi, about 50 psi, about 100 psi, and any pressure therebetween. Element 12: further comprising a check valve arranged within the surface pipe downstream from the pressure regulator valve to prevent backflow of the annulus fluid within the surface pipe into the annulus.

Element 13: wherein the processor is further operable to operate the pressure regulator valve with the control system to maintain a threshold annulus pressure within the annulus. Element 14: wherein the processor is further operable to selectively operate the pressure regulator valve autonomously with the control system and thereby continuously regulate a fluid pressure within the annulus. Element 15: wherein a motor is operatively coupled to the pressure regulator valve, and wherein to operate the pressure regulator valve in the one or more steps and at the predefined time intervals requires the processor to communicate the command signal to the motor to operate the pressure regulator valve. Element 16: wherein the pressure regulator valve is operated in the one or more steps and the predefined time intervals by: opening the pressure regulator valve to a preset opening percentage at one or more of every 10 minutes, every half hour, every hour, every 5 hours, every 10 hours, every 24 hours, and any time subset therebetween; and bleeding the annulus fluid from the annulus and thereby achieving a known pressure drop of at least one of about 25 psi, about 50 psi, about 100 psi, and any pressure therebetween. Element 17: wherein the processor is further operable to enable continuous, real-time operational positional adjustments of the pressure regulator valve with the control system and thereby maintain an optimum pressure within the annulus.

By way of non-limiting example, exemplary combinations applicable to A, B and C include: Element 7 with Element 8; Element 13 with Element 15; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including." "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method, comprising:

receiving a real-time annulus pressure of an annulus defined between a production tubing and an inner wall of a wellbore;

comparing the real-time annulus pressure to a predetermined target pressure for the annulus;

sending a command signal to a pressure regulator valve in fluid communication with the annulus based on the comparison; and based on the command signal, operating the pressure regulator valve in one or more steps and at predefined time intervals to thereby selectively bleed an annulus fluid from the annulus to thereby prevent rapid decompression of the annulus and protect a power cable extending within the annulus to a downhole electrical submersible pump (ESP) assembly from damage.

2. The method of claim 1, further comprising operating the pressure regulator valve to maintain the annulus pressure within the annulus below the predetermined target pressure for the annulus.

3. The method of claim 1, further comprising selectively operating the pressure regulator valve autonomously and thereby continuously regulating the annulus pressure within the annulus.

4. The method of claim 1, wherein the pressure regulator valve comprises a motor, and wherein operating the pressure regulator valve in the one or more steps and at the predefined time intervals comprises:

communicating the command signal to the motor to operate the pressure regulator valve; and achieving a known pressure drop within the annulus by bleeding the annulus fluid from the annulus at the predefined time intervals.

5. The method of claim 1, wherein operating the pressure regulator valve in the one or more steps and the predefined time intervals comprises:

opening the pressure regulator valve to a preset opening percentage at one or more of every 10 minutes, every half hour, every hour, every 5 hours, every 10 hours, every 24 hours, and any time subset therebetween; and bleeding the annulus fluid from the annulus and thereby achieving a known pressure drop of at least one of about 25 psi, about 50 psi, about 100 psi, and any pressure therebetween.

6. The method of claim 1, further comprising preventing backflow of the annulus fluid into the annulus using a check valve arranged within a surface pipe downstream from the pressure regulator valve.

7. The method of claim 1, wherein operating the pressure regulator valve in the one or more steps and the predefined time intervals comprises selectively opening and closing the pressure regulator valve for the predefined time intervals to decrease the annulus pressure below the predetermined target pressure for the annulus.

8. A well system, comprising:

production tubing arranged within a wellbore to thereby define an annulus;

a downhole electrical submersible pump (ESP) assembly arranged at a distal end of the production tubing and including a power cable extending within the annulus;

a pressure regulator valve in fluid communication with the annulus; and a control system communicably coupled to the pressure regulator valve and programmed to operate the pressure regulator valve to selectively bleed an annulus fluid from the annulus in one or more steps and at predefined time intervals to thereby protect the power cable within the annulus by preventing rapid decompression of the annulus.

9. The well system of claim 8, wherein the control system is operable to receive real-time annulus pressure measurements and is further programmed to:

compare the real-time annulus pressure measurements with a predetermined target pressure for the annulus; and send a command signal to open the pressure regulator valve when the real-time annulus pressure measurements exceed the predetermined target pressure.

10. The well system of claim 9, wherein the control system is further programmed to maintain a threshold pressure within the annulus.

11. The well system of claim 8, wherein the pressure regulator valve comprises a motor and the control system communicates with the motor to operate the pressure regulator valve to achieve a known pressure drop within the annulus.

12. The well system of claim 8, wherein operating the pressure regulator valve in the one or more steps and the predefined time intervals comprises:

opening the pressure regulator valve to a preset opening percentage at one or more of every 10 minutes, every half hour, every hour, every 5 hours, every 10 hours, every 24 hours, and any time subset therebetween; and bleeding the annulus fluid from the annulus and thereby achieving a known pressure drop of at least one of about 25 psi, about 50 psi, about 100 psi, and any pressure therebetween.

13. The well system of claim 8, further comprising a check valve arranged within a surface pipe downstream from the pressure regulator valve to prevent backflow of the annulus fluid within the surface pipe into the annulus.

14. The well system of claim 8, wherein operating the pressure regulator valve in the one or more steps and the predefined time intervals comprises selectively opening and closing the pressure regulator valve for the predefined time intervals to decrease the annulus pressure below a threshold pressure for the annulus.

15. A non-transitory, computer readable medium programmed with computer executable instructions that, when executed by a processor of a computer unit, cause the processor to:

receive a real-time annulus pressure of an annulus defined between production tubing extended into a wellbore and an inner wall of the wellbore, wherein a downhole electrical submersible pump (ESP) assembly is arranged on the production tubing and a power cable of the ESP assembly extends within the annulus;

compare the real-time annulus pressure with a predetermined target pressure for the annulus;

send a command signal based on the comparison; and based on the command signal, operate the pressure regulator valve in one or more steps and at predefined time intervals to thereby selectively bleed an annulus fluid from the annulus to thereby protect the power cable within the annulus from damage.

16. The non-transitory, computer-readable medium of claim 15, wherein the processor is further operable to maintain the annulus pressure within the annulus below the predetermined target pressure for the annulus.

17. The non-transitory, computer-readable medium of claim 15, wherein the processor is further operable to selectively operate the pressure regulator valve autonomously and thereby continuously regulate the annulus pressure within the annulus.

18. The non-transitory, computer-readable medium of claim 15, wherein the pressure regulator valve comprises a motor, and wherein the pressure regulator valve is operated in the one or more steps and at the predefined time intervals by communicating the command signal to the motor to operate the pressure regulator valve to achieve a known pressure drop within the annulus.

19. The non-transitory, computer-readable medium of claim 15, wherein the pressure regulator valve is operated in the one or more steps and at the predefined time intervals by:

opening the pressure regulator valve to a preset opening percentage at one or more of every 10 minutes, every half hour, every hour, every 5 hours, every 10 hours, every 24 hours, and any time subset therebetween; and bleeding the annulus fluid from the annulus and thereby achieving a known pressure drop of at least one of about 25 psi, about 50 psi, about 100 psi, and any pressure therebetween.

20. The non-transitory, computer-readable medium of claim 15, wherein the pressure regulator valve is operated in the one or more steps and at the predefined time intervals by selectively opening and closing the pressure regulator for the predefined time intervals to decrease the annulus pressure below the predetermined target pressure for the annulus.

* * * * *